United States Patent [19]

Pyo et al.

[11] 4,407,090

[45] Oct. 4, 1983

[54] NEEDLEWORK TOY

[76] Inventors: Kwan-sung Pyo, 619-I, Kilum-dong, Sungbook-ku, Seoul; Moon-sung Park, 9-289, Hongun-dong, Sudaemoon-ku, Seoul, both of Rep. of Korea

[21] Appl. No.: 299,414

[22] Filed: Sep. 4, 1981

[30] Foreign Application Priority Data

Jul. 13, 1981 [KR] Rep. of Korea ..... 81-4969

[51] Int. Cl.[3] ..... A63H 5/00

[52] U.S. Cl. ..... 46/118

[58] Field of Search ..... 46/44, 118, 119, 123, 46/124, 128, 129, 148, 174, 175 R, 178, 179, 180

[56] References Cited

U.S. PATENT DOCUMENTS

| | | | |
|---|---|---|---|
| 1,229,102 | 6/1917 | Lloyd | 46/118 |
| 1,332,732 | 3/1920 | Lizzi | 46/119 |
| 1,691,443 | 11/1928 | Lloyd | 46/118 |
| 2,741,871 | 4/1956 | Polk | 46/118 |
| 2,974,440 | 3/1961 | Clark | 46/118 |
| 3,237,344 | 3/1966 | Ostrander | 46/118 |
| 3,924,351 | 12/1975 | Terzian | 46/118 |
| 3,928,933 | 12/1975 | Twamoto | 46/119 |
| 4,212,132 | 7/1980 | Lewanoni | 46/118 |

FOREIGN PATENT DOCUMENTS

| | | | |
|---|---|---|---|
| 163604 | 6/1955 | Australia | 46/118 |
| 361641 | 7/1906 | France | 46/129 |
| 235028 | 6/1925 | United Kingdom | 46/118 |
| 774191 | 5/1957 | United Kingdom | 46/118 |
| 871728 | 6/1961 | United Kingdom | 46/118 |

*Primary Examiner*—F. Barry Shay

*Attorney, Agent, or Firm*—Sughrue, Mion, Zinn, Macpeak & Seas

[57] ABSTRACT

A stuffed toy animal mechanism for simulating foreleg movement and crying includes an air bellows 12 having a whistle 11 mounted between a press plate 2 and arms 8 of a spring wire 9. Levers 4 having foreleg extension plates 6 are pivotable about a fulcrum pin 7 inserted through a support member 3 of the press plate. Upon squeezing the animal body the bellows is compressed to sound the crying whistle, and the forelegs simultaneously swing apart due to the pivoting of the levers.

1 Claim, 4 Drawing Figures

NEEDLEWORK TOY

BACKGROUND OF THE INVENTION

The present invention relates to a needlework toy animal whose forelegs move and which cries when its body is squeezed to thus provide both visual and auditory effects.

Conventional animal toys generally utilize pin structures to move the legs and arms, and have complicated structural disadvantages. Moreover, they do not realistically behave as an actual animal. In other words, they do not provide simultaneous leg or arm movements and crying.

SUMMARY OF THE INVENTION

It is an object of the invention to provide a needlework toy animal having simultaneous foreleg movement and crying effects upon squeezing the body, which can be played with and enjoyed by children.

DETAILED DESCRIPTION OF THE INVENTION

Figure 1:
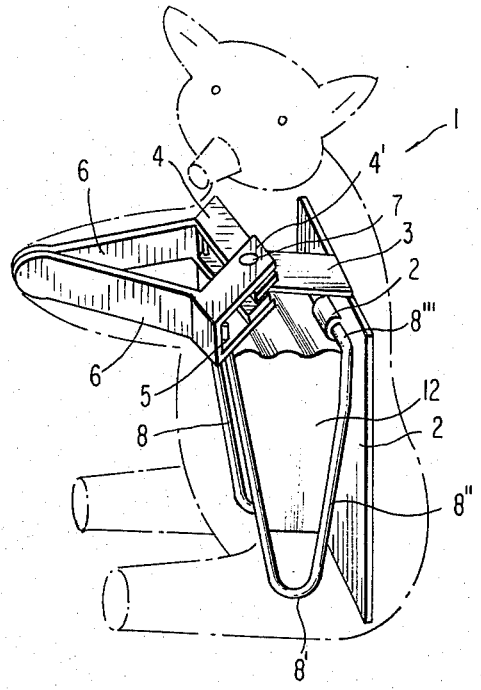
FIG. 1 is a perspective view showing the toy according to the present invention.
Figure 4:
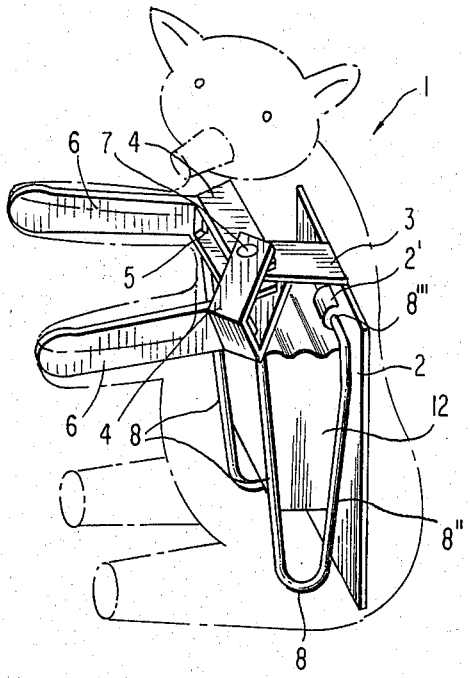
FIG. 4 is a perspective view showing the motion of the invention.
Figure 2:
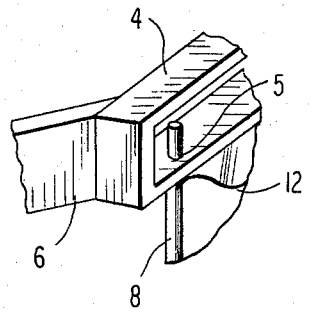
FIG. 2 is a perspective view showing part of FIG. 1.
Figure 3:
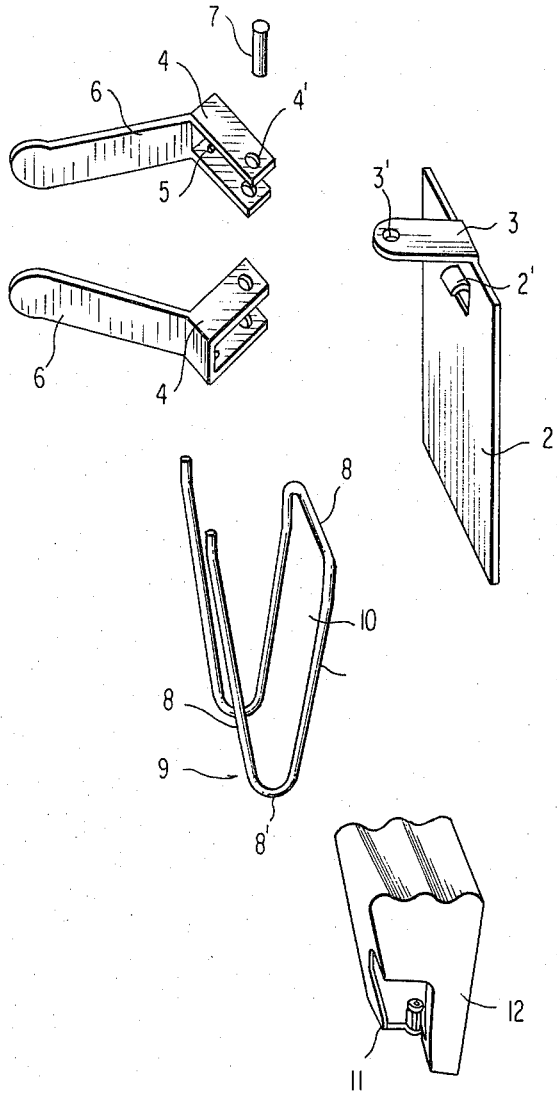
FIG. 3 is an exploded perspective view showing the mechanical parts of the invention.

Referring to the drawings, at the center of one end of a press plate 2 a support 3 is formed at a right angle, and at the end of said support a fulcrum hole 3' is provided. Two rectangularly bent fulcrum levers 4 having fulcrum holes 4', elongate plates 6 and wire receiving holes 5 are joined to the support 3 by a pin 7 inserted through the fulcrum hole 3' and fulcrum holes 4', with the plates 6 of each fulcrum lever extending outwardly at an angle. Spring wire 9 is formed to have two front straight parts 8, bent parts 8', rear straight parts 8'' and a level connecting part 8'''. The center of the connecting part is clamped by a hook 2' formed on the inner side of the press plate 2, and an air bag 12 containing a whistle 11 is disposed within the space 10 of the spring wire 9. The assembled structure is placed inside a toy animal 1 with the plates 6 extending into the forelegs or arms of the animal. The ends of the two straight parts 8 are inserted into the receiving holes 5.

When the press plate 2 and straight spring wire parts 8 are squeezed together, the foreleg plates 6 open due to the levers 4 rotating about fulcrum pin 7, this simulating an actual animal movement and simultaneously the compression of the air bag 12 causes the whistle 11 to emit an animal-like cry to the enjoyment of children.

The animal-like behaviors such as crying and movement of forelegs is achieved without the complicated structure of the prior art, and in addition the toy cannot be easily damaged by children due to its simple and rugged structure.

What is claimed is:

1. A toy animal mechanism, comprising:

(a) a press plate (2) having a support arm (3) extending laterally outwardly from an upper edge thereof.

(b) a spring wire (9) having two U-shaped portions joined by a connecting section (8'''), and defining a generally wedge-shaped space (10) between legs of the U-shaped portions, (c) an air bellows (12) having a crying whistle (11) mounted therein disposed within said wedge-shaped space, (d) clamping means (2') mounting the spring wire connecting section to the press plate proximate the support arm, (e) a pair of U-shaped levers (4) each having an elongate foreleg plate (6) extending outwardly therefrom, (f) a pin member (7) pivotally coupling leg ends of said levers to an outermost end of the support arm, and (g) apertures (5) individually provided in a leg of each lever remote from said pin member for receiving free leg ends of the U-shaped portions of the spring wire, (h) whereby upon installation within the body of a toy animal with each elongate plate extending into a foreleg of the animal, the squeezing of the animal body acts to compress the air bellows and thereby activate the crying whistle, and to simultaneously pivot the levers and plates about the pin member to simulate foreleg movement.

* * * * *